US005404826A

United States Patent [19]

Rudibaugh et al.

[11] Patent Number: 5,404,826

[45] Date of Patent: Apr. 11, 1995

[54] BEARING ADAPTER FOR RAILWAY TRUCKS HAVING DOWNWARD DEPENDING ENDS ON ADAPTER PLATE FOR PROTECTING THE ADAPTER THRUST LUGS

[75] Inventors: John W. Rudibaugh, West Chester; Charles L. van Auken, Dillsburg, both of Pa.

[73] Assignee: Pennsy Corporation, West Chester, Pa.

[21] Appl. No.: 84,286

[22] Filed: Jun. 28, 1993

Related U.S. Application Data

[63] Continuation-in-part of Ser. No. 742,593, Aug. 8, 1991, abandoned.

[51] Int. Cl.[6] ..... B61F 5/26

[52] U.S. Cl. ..... 105/222; 105/224.1; 105/225

[58] Field of Search ..... 105/206.1, 218.1, 220, 105/221.1, 223, 224.1, 225, 222

[56] References Cited

U.S. PATENT DOCUMENTS

| | | | |
|---|---|---|---|
| 3,211,112 | 10/1965 | Baker | 105/224.1 |
| 3,381,629 | 5/1968 | Jones | 105/218.1 |
| 3,844,226 | 10/1974 | Brodeur et al. | 105/222 |
| 3,897,736 | 8/1975 | Tack | 105/222 X |
| 4,078,501 | 3/1978 | Neumann et al. | 105/218.1 X |
| 4,373,446 | 2/1983 | Cope | 105/224.1 |
| 4,433,629 | 2/1984 | Roush, Jr. | 105/222 |
| 4,674,412 | 6/1987 | Mulcahy et al. | 105/218.1 X |
| 4,785,740 | 11/1988 | Grandy | 105/225 |
| 4,991,864 | 2/1991 | Potsch | 280/441 |
| 5,081,935 | 1/1992 | Pavlick | 105/218.1 X |
| 5,261,332 | 11/1993 | Grandy | 105/218.1 |

*Primary Examiner*—Robert J. Oberleitner
*Assistant Examiner*—S. Joseph Morano
*Attorney, Agent, or Firm*—Allegretti & Witcoff, Ltd.

[57] ABSTRACT

An improved adapter assembly for use in a railcar truck where an axle and bearing are loosely journaled in the pedestal area of a side frame, the adapter assembly being mounted above the bearing in the pedestal opening and including an adapter plate which is mounted on the top of the adapter, the adapter together with the bearing and axle being capable of lateral movement relative to the side frame.

20 Claims, 6 Drawing Sheets

Fig. 1
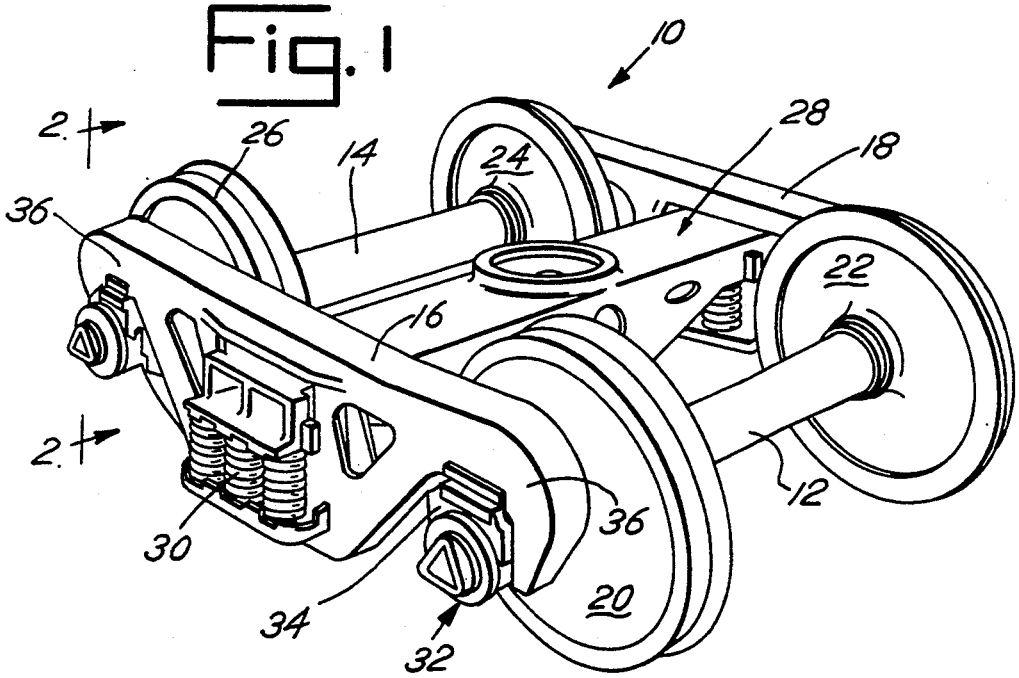
Fig. 3
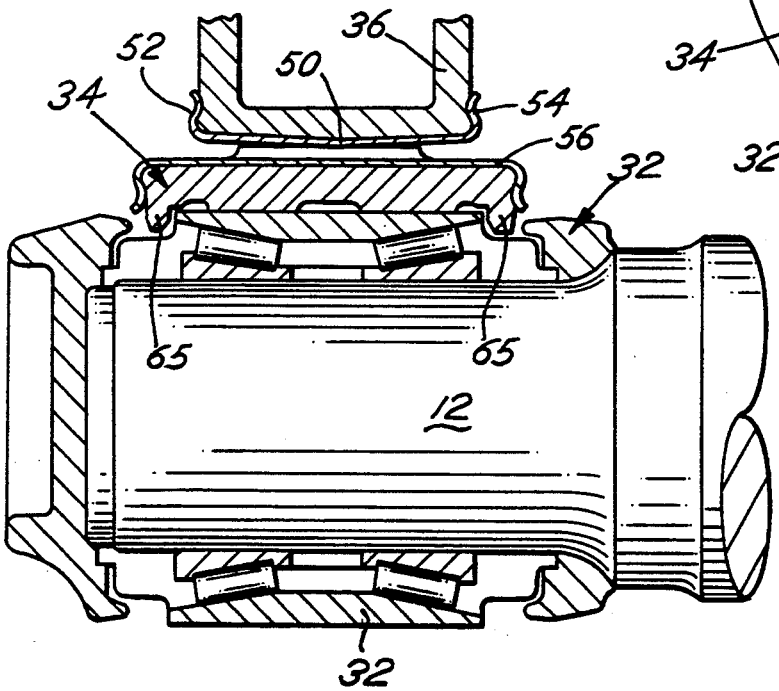
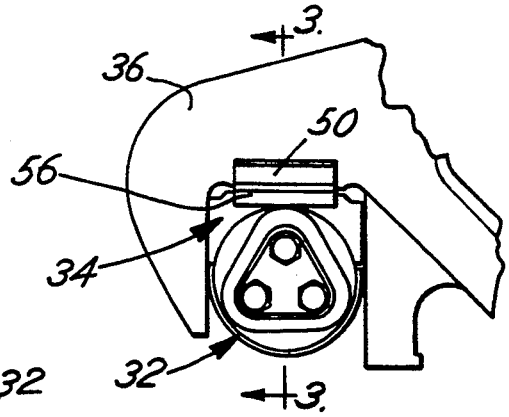
Fig. 2

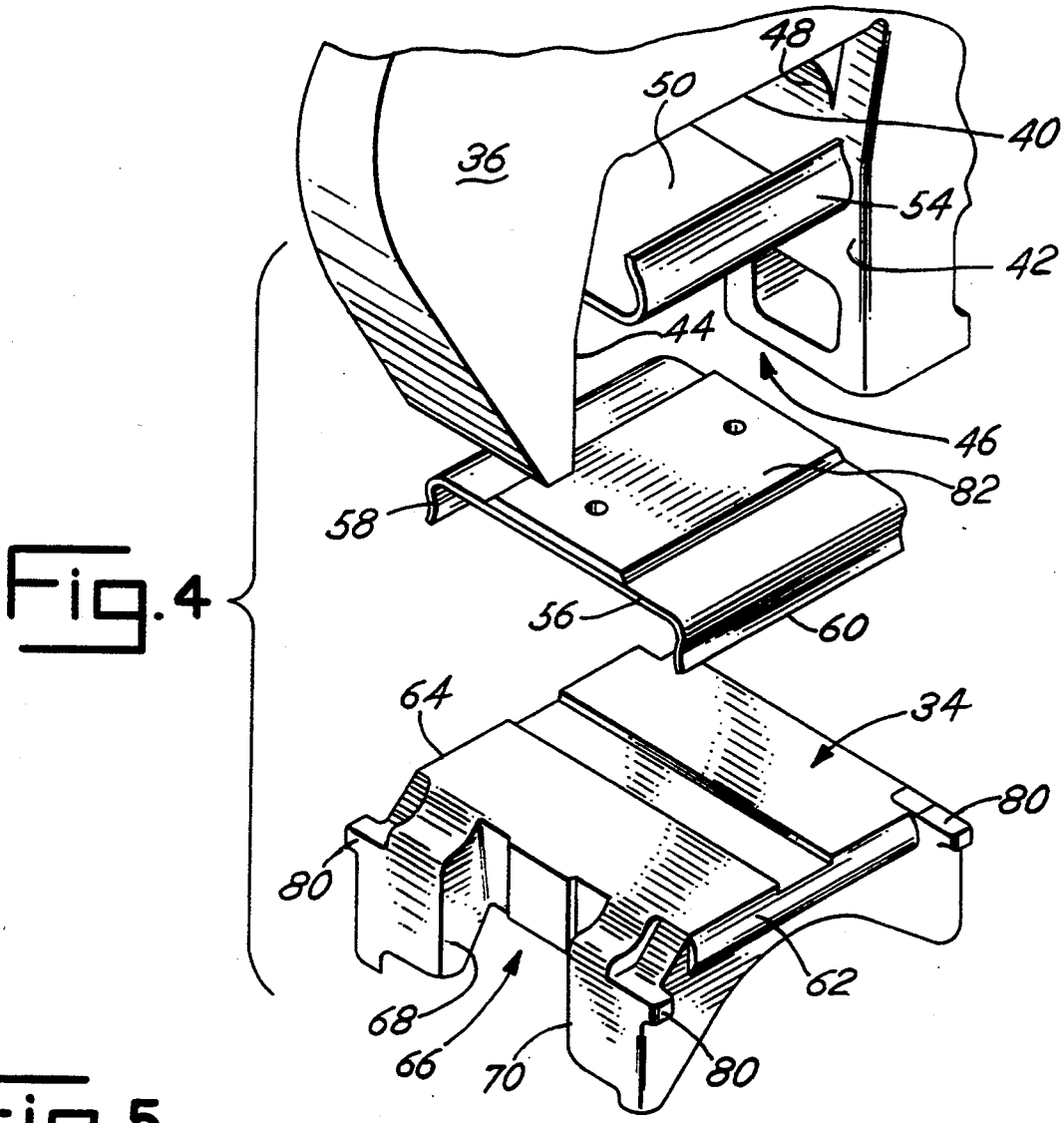
Fig. 4
Fig. 5
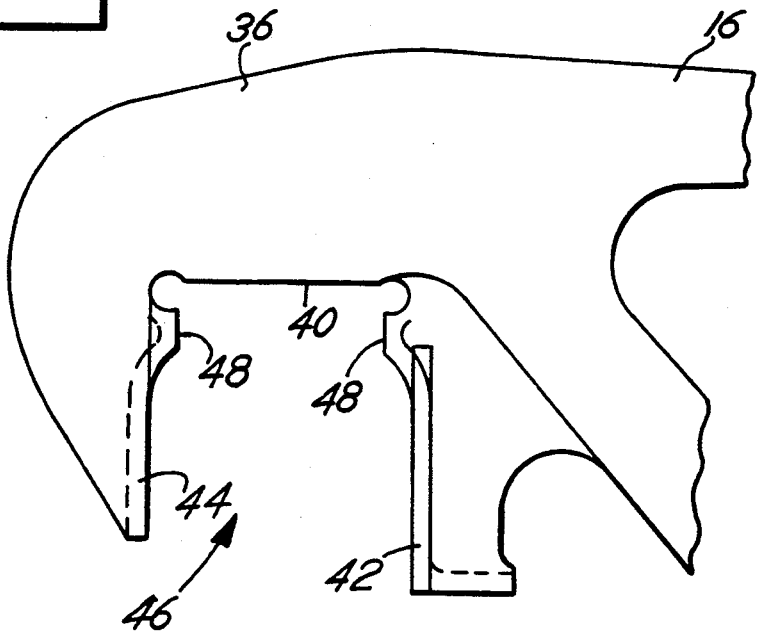

Fig.6
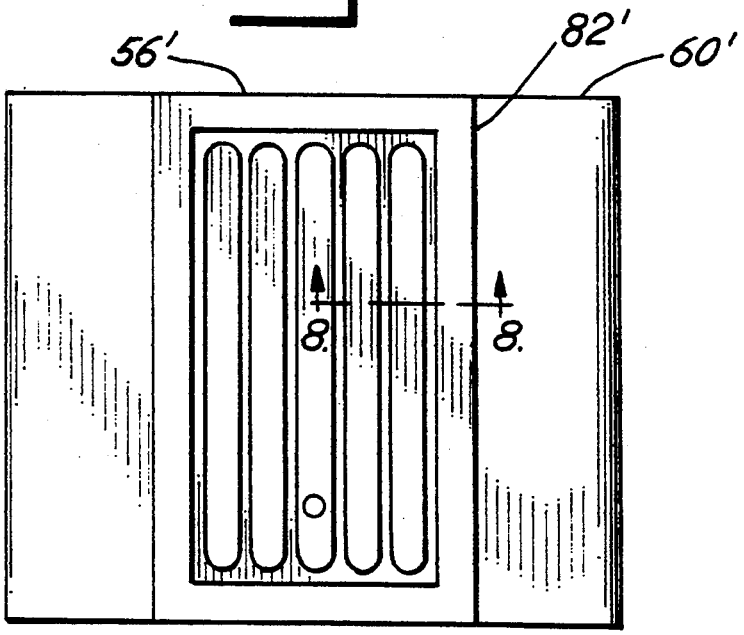
Fig.7
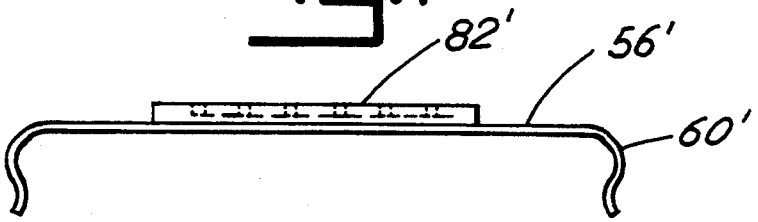
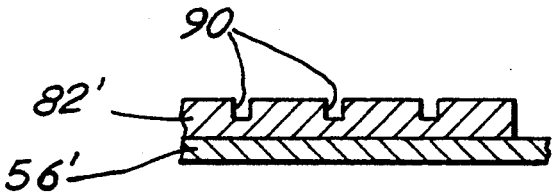
Fig.8

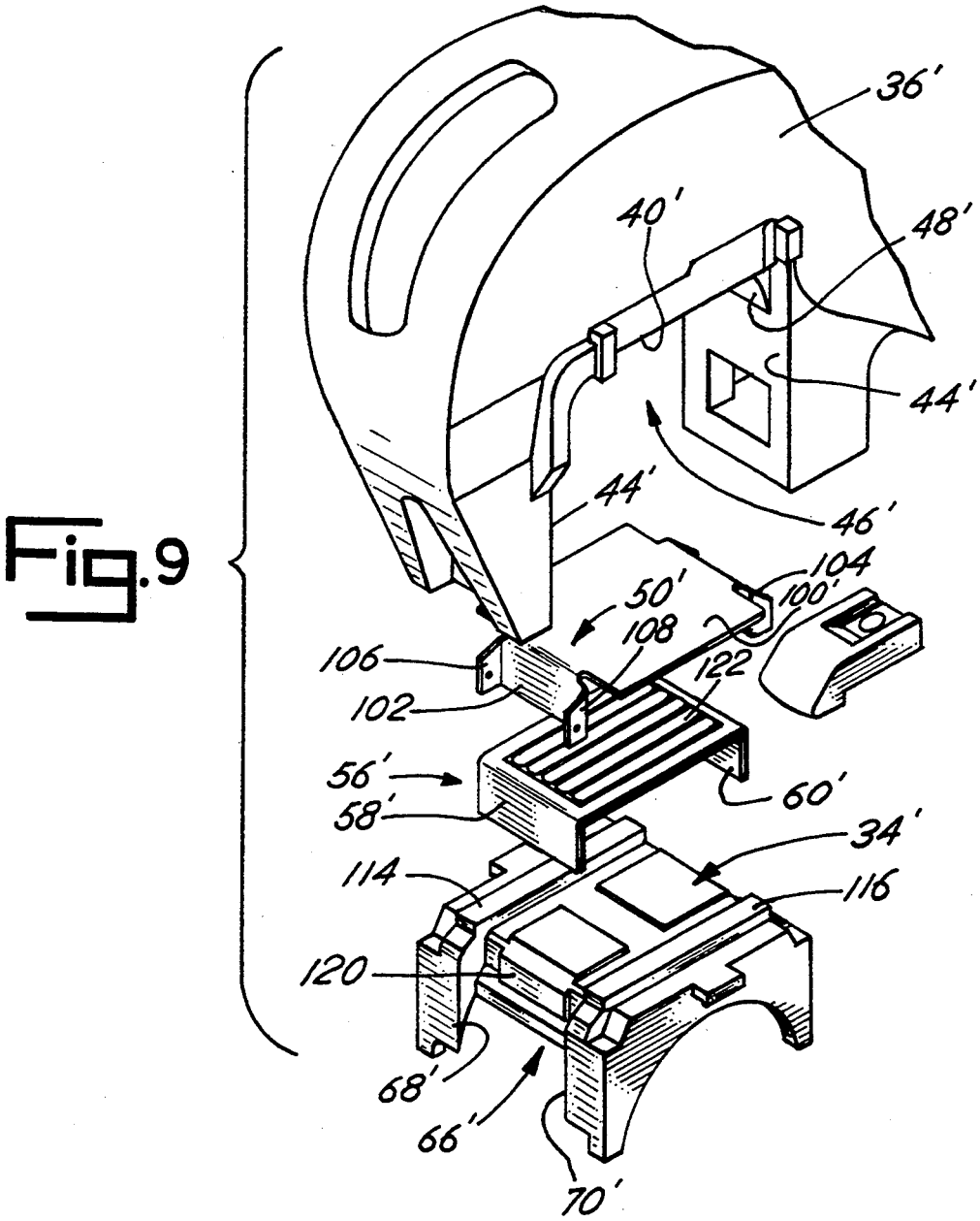
Fig. 9
Fig. 10
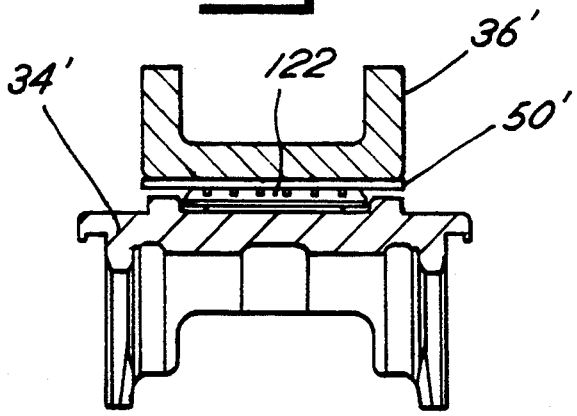

BEARING ADAPTER FOR RAILWAY TRUCKS HAVING DOWNWARD DEPENDING ENDS ON ADAPTER PLATE FOR PROTECTING THE ADAPTER THRUST LUGS

RELATED PRIOR APPLICATION

This application is a continuation-in-part of U.S. Ser. No. 07/742,593, filed Aug. 8, 1991, now abandoned.

BACKGROUND OF THE INVENTION

FIELD OF THE INVENTION

The present invention relates to a freight car truck, and in particular to the pedestal area where the axle and bearing are loosely journaled to the side frame.

A common phenomenon with railcar trucks is referred to as truck hunting, which is a swiveling action of the truck while running down the track. Hunting is a consequence of the evolution of the friction bearings being replaced by roller bearings, the latter reducing the axial movements of the wheel set, and also a consequence of increased operating speeds.

With reduced lateral movement in the wheel set, contact to the side frame thrust lugs is achieved quickly, and the resulting force is transmitted through the side frame to the bolster and then to the car body. Excessive hunting causes high lateral accelerations creating wear to the truck components as well as the track. The foregoing is also a cause of lading damage.

There have been attempts at increasing the lateral movement of the wheel set relative to the side frame through the use of elastomeric shear pads in the pedestal area and increased openings in the thrust lug area. Such an approach is disclosed in Jones U.S. Pat. No. 3,381,629. However, the foregoing known approach has not been successful.

The present invention comprises use of an adapter and adapter pad which can slip, allowing the wheel set lateral movement without contact to the side frame, thereby lessening the damaging forces, while still achieving running speeds which may approach 80 miles per hour, a substantial increase over conventional railcars. Another advantage of the present invention is that it precludes the need for constant contact side bearings, thereby affording initial savings and reduced maintenance.

Brodeur et al. U.S. Pat. No. 3,844,226 discloses an arrangement where the two wheels, the axle and the bearings, which are fixed to one another, can move laterally relative to the side frame. At column 2, line 32, there is a reference to a total lateral movement of $\frac{3}{4}$ inch, although there is no disclosure as to how the components would have to be modified to achieve such a magnitude of lateral movement. Furthermore, Brodeur et al. discloses a non-metallic plate 30 which would not hold up well in use and would be subject to deterioration in a relatively short time.

A preferred embodiment of the present invention includes both a wear plate or pedestal liner which mounts under the pedestal portion of the side frame, and also an adapter plate which mounts over the top of the bearing adapter. A special adapter pad is mounted either on the underside of the pedestal liner or on the top of the adapter plate.

Wear plates or pedestal liners per se are known in the art and are disclosed in U.S. Pat. Nos. 3,897,736 and 4,230,371. However, the foregoing prior art patents do not teach use of the adapter plate or the adapter pad of the present invention. The present invention further includes application of a novel low friction coating to the bottom of the wear plate or pedestal liner.

Jones U.S. Pat. No. 3,381,629 is relevant to the extent that it teaches lateral movement between the wheel set and bearing on the one hand and the side frame. FIG. 2 of the Jones patent shows an upper steel plate 32, a rubber pad 30, and a lower steel plate 33. Jones shows a side frame in FIG. 3 having ribs at 36 and 37. While there is limited clearance between the ribs 36 and 37, and the upper steel plate 32, such clearance is limited and does not afford meaningful lateral movement.

Jones discloses an assembly where lateral movement is permitted, but in a manner totally different from our present invention. Jones provides lateral movement due to deformation or shearing of the rubber pad 30. One of the problems with the Jones structure is that when the robber pad deforms or shears laterally in one direction, it will tend to bounce back or rebound in a somewhat violent manner, which can cause significant wear to the side frame, bolster and other components as well as resultant deterioration of the quality of the car ride.

Still referring to the above Jones patent, FIG. 5 shows the manner in which lateral movement is limited. A portion of the side frame is shown at 52, and it fits into an opening between opposed shoulders 56 of an adapter. Spaces are shown at 53 and 54 which define the amount of lateral movement permitted between the wheel set and adapter on the one hand and the side frame. In FIG. 5 of the Jones patent, the space between the adapter shoulders 56 is standard, but Jones modifies the side frame to make the member 52 narrower than in a standard side frame, and in this manner Jones permits the relative lateral movement discussed above, under the control of the deformable rubber pad 30.

Thus, in conventional truck assemblies, there is no lateral movement, and any spaces as shown at 53 and 54 in FIG. 5 of Jones would be nominal, and not sufficient to permit meaningful lateral movement. Jones thus modified the side frame and reduced the width of the member 52 to make relative lateral movement possible.

In a preferred embodiment of the present invention, a standard side frame is used, meaning that the standard width of the side frame member shown at 52 in Jones is not reduced. Instead, the present invention involves opening up the space between the shoulders or lugs shown at 56 in FIG. 5 of the Jones patent.

Specifically, it is a feature of the present invention to increase the standard distance between those adapter shoulders 56 by an amount approximately equal to $\frac{3}{4}$ inch. For example, the preferred distance between those shoulders 56 is approximately 4 and 9/16 inches, which is $\frac{3}{4}$ inch greater than standard, thereby permitting relative lateral movement between the wheel set and the side frame of approximately $\frac{3}{4}$ inch.

The foregoing objects and advantages of the invention will be apparent from the following description of certain preferred embodiments thereof, taken in conjunction with the accompanying drawings.

DESCRIPTION OF THE DRAWINGS

FIG. 1 is a perspective view of a truck assembly including an adapter assembly in accordance with the present invention;

FIG. 2 is an enlarged, fragmentary side elevational view looking in the direction of the arrows 2—2 of FIG. 1;

FIG. 3 is a further enlarged vertical sectional view taken along the line 3—3 of FIG. 2;

FIG. 4 is an exploded perspective view showing the pedestal portion of a side frame, a wear plate or pedestal liner, an adapter, and an adapter plate having an adapter pad mounted on the top thereof;

FIG. 5 is an enlarged fragmentary, detail side elevational view of the pedestal portion of the side frame, illustrating opposed thrust lugs which cooperate with opposed shoulders on the adapter which define thrust lug openings to limit the magnitude of relative lateral movement between the side frame and the assembly of the wheel set, axle and adapter;

FIG. 6 comprises a top plan view of an alternative embodiment of an adapter plate having a polymer pad mounted thereon;

FIG. 7 is a side elevational view of the adapter plate and pad of FIG. 6;

FIG. 8 is an enlarged sectional view taken along the lines 8—8 of FIG. 6;

FIG. 9 is an exploded perspective view of an alternative embodiment of the invention where the components are modified in order to reduce wear in the areas where the thrust lugs slide against the sides of the bearing adapter during relative lateral movement of the adapter relative to the side frame;

FIG. 10 is a vertical sectional view showing a portion of the bearing adapter assembled in the pedestal opening with the pedestal wear plate and the adapter pad of FIG. 9 assembled between the top of the pedestal opening and the top of the bearing adapter;

Figure 11:
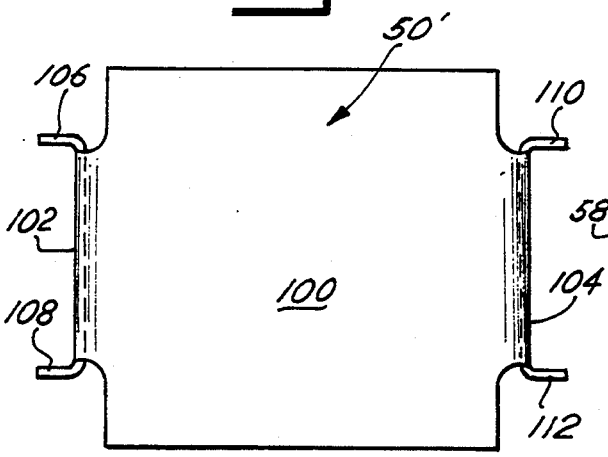
FIG. 11 is an enlarged top plan detail view of the pedestal wear plate of the alternative embodiment of FIG. 9.

Now, in order to acquaint those skilled in the art with the manner of making and using our invention, we shall describe, in conjunction with the accompanying drawings, certain preferred embodiments of the invention.

DETAILED DESCRIPTION OF THE INVENTION

FIG. 1 shows a truck assembly 10 including a pair of axles 12 and 14, a pair of side frames 16 and 18, four wheels 20, 22, 24 and 26, and a bolster 28 which extends between the side frames with its opposed ends projecting into openings in the side frames so as to be supported on spring assemblies shown at 30. The truck assembly 10 further includes four bearings 32, each having an adapter assembly 34 disposed between the bearing and the underside of a pedestal portion 36 of the side frame.

FIG. 2 shows one of the pedestal portions 36 of the side frame, each side frame having one such pedestal portion 36 at each end thereof to receive in the pedestal opening a bearing 32. The adapter 34 and related components are disposed between the top of the bearing and the underside of the pedestal, the latter being shown at 40 in FIGS. 4 and 5. FIGS. 4 and 5 further show a pair of side walls 42 and 44 which define a pedestal opening 46. In addition, on each of the side walls 42 and 44, near the upper ends thereof, a thrust lug 48 is formed.

As shown in FIGS. 3 and 4, a wear plate or pedestal liner 50 is provided which comprises a generally flat plate having upwardly bent end walls 52 and 54. The pedestal liner is pressed up against the underside 40 of the pedestal portion of the side frame so the opposed upwardly bent end portions 52 and 54 grip the walls of the side frame thereby securing the liner 50 in position against the underside of the pedestal wall 40 as shown in FIGS. 2 and 3. A feature of the present invention involves application of a special coating to the bottom of the liner 50, as will be described later herein. The liner 50 itself is preferably made of metal.

A further important feature of our invention comprises an adapter plate 56 which preferably is made of metal and is formed with downwardly bent end walls 58 and 60 (see FIG. 4) which are dimensioned to grip the sides of the adapter 34 when the adapter plate 56 is pressed down against the top of the adapter 34 as shown in FIG. 3. The adapter 34 is formed with a pair of rounded opposed edges 62 and 64 intended to cooperate with the downwardly bent ends 58 and 60 of the adapter plate 56 to aid in securely mounting the adapter plate on top of the adapter.

As shown in FIG. 3, the adapter 34 has opposed depending end flanges 65 which extend down over a portion of the bearing 32 to prevent significant lateral or axial movement between the adapter 34 and the axle 12, the axle being laterally fixed relative to the wheels as previously described. However, in accordance with the present invention, relative lateral or axial movement, left and right movement as shown in FIG. 3, is permitted between the adapter 34, axle 12, and wheels on the one hand, and the side frame 16, 36. The uppermost structure in FIG. 3 comprises the pedestal portion 36 of the side frame 16, and lateral or axial movement between that side frame and the adapter 34 and related components is a feature of the present invention.

Before describing the engaging surfaces of the pedestal liner 50 and the adapter plate 56, we will first describe the physical structure which permits and limits the magnitude of such relative lateral movement. FIG. 4 shows a portion of one of the opposed thrust lugs 48 formed near the top of the pedestal opening 46 on the side frame 16. The two thrust lugs 48 are best shown in FIG. 5. With reference to FIG. 4, when the components are assembled, the thrust lugs 48 fit down into openings 66 in each side of the adapter, such openings being defined by opposed shoulders 68 and 70.

As previously explained, in a conventional truck assembly, the width or axial dimension of the thrust lugs 48 is only slightly less than the width or axial dimension of the thrust lug opening 66 in FIG. 4, with the result that no meaningful relative lateral movement is permitted. In accordance with the present invention, in contrast with Jones U.S. Pat. No. 3,381,629, the width or axial dimension of the side frame 16, 36 is not reduced, but is standard.

Instead, we have opened up the width or axial dimension of the thrust lug opening 66 in FIG. 4. We increase that dimension by ¾ inch, making it a total of 4 and 9/16 inches. As a result, a total of approximately ¾ inch of relative lateral movement is permitted between the side frame 16 and the adapter 34. Relative lateral movement beyond that amount is not permitted, as the thrust lugs 48 on the side frame will engage the shoulders 68 and 70 which define the thrust lug opening 66 in each of the two sides of the adapter 34.

Reference is now made to the matter of the sliding contact between the components during such relative lateral movement. As previously described, the wear plate 50 is mounted immediately under the pedestal wall 40 so as to provide a wear or bearing surface. In addition, a special coating is formed on the underside of the wear plate 50.

With respect to adapter plate 56, as best shown in FIG. 4, the plate 56 is mounted on the adapter 34 so that it is generally fixed relative to the adapter. The adapter is formed with four horizontally projecting lugs 80. The four lugs 80 cooperate with the adapter plate 56 to prevent longitudinal movement of the adapter plate 56 relative to adapter 34. In addition, as previously described, the downwardly bent end portions 58 and 60 of the steel adapter plate 56 fit over curved end portions 62 and 64 on the adapter to retain the plate 56 on the adapter and prevent axial movement relative thereto.

One further important component of the present invention comprises a polymer pad shown at 82 in FIG. 4. The pad 82 can be mounted on the underside of the pedestal liner 50, or it can be mounted on the top of the adapter plate 56 as shown in FIG. 4. The preferred embodiment is as shown in FIG. 4, with the polymer pad 82 mounted on the top of the steel adapter plate 56.

During relative lateral movement as described hereinabove, the adapter plate 56 having the polymer pad 82 mounted thereon will move axially relative to the pedestal liner 50, and of course the sliding surfaces in contact will comprise the underside of the pedestal liner 50 and the top of the polymer pad 82. Both such surfaces are preferably designed to facilitate such sliding movement, particularly since there is considerable downward load on the side frame.

We will now describe the above-mentioned sliding surfaces in greater detail. The adapter pad shown at 82 in FIG. 4 is preferably a low friction polymer pad which is bonded to the upper surface of the steel adapter plate 56. In accordance with the present invention, a particularly suitable pad which affords excellent results is comprised of Uniroyal Adiprene polymer, specially formulated to yield a material offering a low coefficient of friction in the range of 0.05 to 0.15, while still offering good impact resistance typical of elastomers. Uniroyal's Adiprene comprises a Thermoset polyurethane, polyester (PTMG) based, MBOCA cured, 70–75 shore D durometer.

As for the underside of the pedestal liner 50, a preferred coating comprises Permalon 1000 which is an aqueous dispersion specifically for self-lubricating applications requiring tough, well bonded film without creep and cold flow of material. The static coefficient of friction of such coating is 0.011 to 0.098.

A further feature of the invention concerns the upper surface of the adapter 34 as shown in FIG. 4. It is known in the art to form such a surface as curved, namely, convex, the curve having a radius of 60 inches. In accordance with the present invention, the curve extends from the rounded edge or bead shown at 62 in FIG. 4 to the rounded edge shown at 64. In the embodiment of the present invention, such a curved surface extends the full width of the crown to afford more complete support for the adapter plate 56, whereas heretofore such a curved surface did not extend fully to the opposed edges of the crown.

In addition, we provide a radius of 120 inches rather than the usual 60 inches, resulting in a somewhat flatter upper surface on the adapter 34. The purpose of the foregoing is to provide more complete support for adapter plate 56. In accordance with a preferred embodiment, the adapter plate 56 may be attached to adapter 34 by simply snapping it in position, due to cooperation between downwardly bent plate ends 58 and 60 and the curved ends or beads 62 and 64 on the adapter.

The adapter 34 is similar to a standard adapter, but differs in the increased radius of 120 inches as described above, and in the fact that the curved upper surface extends fully to opposite edges 62 and 64 of the adapter, which is not true with standard adapters. The lugs 80 are also novel and serve to longitudinally retain the adapter plate 56. The radiused beads at 62 and 64 for cooperation with bent down plate ends 58 and 60 are a further novel feature and serve to retain the plate when it is pressed down into position.

FIGS. 6–8 show an alternative embodiment where a polymer pad 82′ is affixed to the top of an adapter plate 56′. The polymer pad 82′ differs from the pad shown at 82 in FIG. 4 in that it has a plurality of parallel grooves 90 formed in the surface thereof which serve as a reservoir to prevent grease from extruding between the contacting surfaces comprising the pad 82′ and the underside of the pedestal liner as shown at 50 in FIG. 4. Such grease reduces the coefficient of friction and facilitates the relative lateral movement between the contacting parts.

Reference is now made to FIGS. 9 and 10 which illustrate an alternative embodiment of the present invention. There is shown a pedestal portion 36′ of a side frame which has a pedestal opening 46′ defined by side walls 42′ and 44′ and a top wall 40′. The pedestal 36′ is essentially the same as the pedestal shown at 36 in FIG. 4.

The embodiment shown in FIG. 9 has a substantially different type of pedestal liner 50′ which is itself known in the art but cooperates with other novel components of the invention to effect very advantageous results. FIGS. 9, 11 and. 12 illustrate the new pedestal liner 50′ which has a flat plate portion 100′ adapted to bear up against the underside 40′ of the pedestal 36′. The pedestal liner 50′ has its two longitudinal ends bent downwardly to form depending end walls 102 and 104. In addition, each of the depending end walls 102 and 104 has its end portions bent outwardly to create tabs shown at 106, 108, 110 and 112.

In the embodiment of FIGS. 4 and 5, a pair of thrust lugs 48 were described which are located on the pedestal opening side walls 42 and 44 proximate the wall 40 which defines the top of the pedestal opening. One such thrust lug 48 is partially shown in FIG. 4 and the two thrust lugs are more fully illustrated in FIG. 5. The alternative embodiment of FIGS. 9 and 10 has similar thrust lugs 48' and they perform the same function as the thrust lugs 48 in the earlier embodiment, as will be discussed more fully hereinafter.

Referring again to FIG. 9, the purpose of the depending end walls 102 and 104 and the outwardly bent tabs 106, 108, 110 and 112 will now be apparent. When the pedestal liner 50' is mounted with the flat portion 100' bearing up against the wall 40' which defines the top of the pedestal opening, the depending end wall 104 together with the outwardly bent tabs 110 and 112 will cover the thrust lug 48'.

In a similar manner, the depending wall 102 together with the outwardly bent tabs 106 and 108 will cover the opposed thrust lug 48' (not shown). As a result, those thrust lugs will be protected from wear and the portions of the pedestal liner which cover the thrust lugs will facilitate lateral sliding movement of the adapter 34' relative to the pedestal 36' as will be more fully described hereinafter. As indicated above, the pedestal liner 50' is known in the art, and the liner is shown in U.S. Pat. No. 4,785,740, issued Nov. 22, 1988.

Reference is now made to the adapter shown at 34' in FIG. 9. The adapter 34' is similar to the adapter shown at 34 in FIG. 4. However, one difference is that the top of the adapter 34' is not formed with a curved surface as described at page 10 herein with respect to the adapter 34. Instead, the adapter 34' is formed with a flat top surface. As illustrated in FIG. 9, the top surface of the adapter 34' is shown with a pair of raised rectangular portions, but those raised portions are not related to the present invention and will not be further described herein.

Another difference in the adapter 34' is that it does not include the four horizontally projecting lugs shown at 80 in FIG. 4. The lugs 80 in FIG. 4 served as a means for preventing longitudinal movement of the adapter plate 56 relative to adapter 34. However, the adapter plate 56' in the embodiment of FIGS. 9 and 10 is oriented and mounted in a different manner so that the lugs 80 are unnecessary.

A further difference in the adapter 34' as shown in FIG. 9 is the distance between the opposed shoulders 68' and 70'. As explained in connection with the embodiment of FIG. 4, when the components of FIG. 9 are assembled, the thrust lugs 48' fit down into openings 66' formed in each side of the adapter 34', such openings being defined by opposed shoulders 68' and 70'. Moreover, lateral movement of the adapter 34' relative to the pedestal 36' is limited when the thrust lugs 48' engage one of the shoulders 68' and 70' which function as stops.

In the embodiment of FIG. 4, the standard width or axial dimension of the thrust lug opening 66 was increased by ¾ inch to a total of 4 and 9/16 inches. As a result, a total of approximately ¾ inch of relative lateral movement is permitted between the side frame 16 and the adapters 34. In the embodiment of FIG. 9, the thrust lug opening 66' is increased to 4 and 13/16 inches due to the fact that the effective width of each thrust lug 48' is increased due to the thickness of the outwardly bent tabs 106 and 108 which overlie the sides of the thrust lugs.

In the embodiment being described, the thickness of the metal pedestal liner 50' is approximately ⅛ inch so the effective width of each thrust lug 48' is increased by approximately ¼ inch. Thus, in order to provide for the same relative lateral movement of ¾ inch between the side frame 16 and the adapters 34', the thrust lug opening of FIG. 9 is increased from 4 and 9/16 inches to 4 and 13/16 inches.

Still another feature of the adapter 34' of FIG. 9 relates to the two longitudinal rails or shoulders 114 and 116. The rails or shoulders 114 and 116 extend the full longitudinal length of the top of the adapter 34' and they are spaced apart a predetermined amount for the purpose of receiving and retaining an adapter plate 56' as will be described below.

Figure 13:
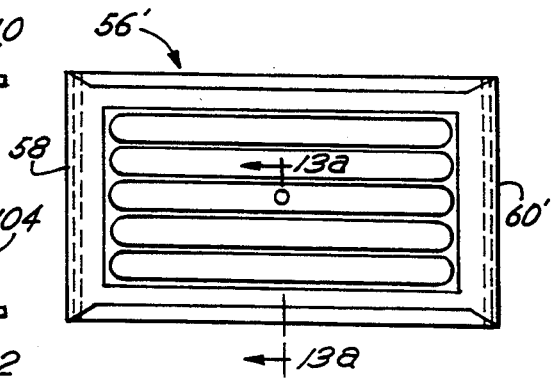
FIG. 13 is an enlarged top plan detail view of an inverted U-shaped adapter plate comprising a formed steel plate backbone and a cover or pad bonded to its top surface, the pad being extended down the outside of the two depending legs of the adapter plate.

The embodiment of FIG. 9 includes an adapter plate 56' which is quite different from the adapter plate 56 of FIG. 4. As shown in FIG. 9, and also in FIGS. 13, **13*a* and 14, the adapter plate 56' is made of metal but has a urethane top layer in the manner of the adapter plate 56. However, the adapter plate 56' is oriented to extend longitudinally rather than transversely, and it has depending end portions 58' and 60' which overlie the longitudinal ends of the adapter 34' when the adapter plate is pressed down against the top of the adapter 34'. When the adapter plate 56' is mounted on the top of the adapter 34', it will fit between the rails or shoulders 114 and 116** and be retained thereby.

An important feature of the adapter plate 56' is that the urethane coating covers not only the top surface of the adapter plate but also extends down the outsides of the depending end walls 58' and 60'. In a preferred embodiment, the adapter plate 56' comprises an inverted, U-shaped, formed steel plate with Uniroyal Adiprene polymer bonded to its top surface, and the polymer extends down the outsides of the depending end portions 58' and 60'.

In accordance with the foregoing embodiment, when the components of FIG. 9 are assembled, the adapter plate 34' and components assembled thereto, including the related axle 12 and wheel set, will be able to move laterally relative to the side frames 16, 18 by a total amount of ¾ inch. Moreover, during such relative movement, the insides of the depending end walls 102 and 104 of the pedestal liner 50', which cover the thrust lugs 48', will bear against the outsides of the depending end walls 58' and 60' of the adapter plate 34'.

As a result, in contrast with the embodiment of FIG. 4, there will be no sliding contact against the opposed end walls of the adapter 34', such as the wall shown at 120 in FIG. 9, because that wall will be protected by the depending end wall 58' of the adapter plate 56', 58' is covered by a polymer as described above. In addition, there will be no sliding contact directly against the insides of the thrust lugs 48' because those thrust lugs are protected by the depending end walls 102 and 104 of the pedestal liner 50'. FIG. 9 shows the manner in which the polymer top surface 122 of the adapter plate 56' is formed with longitudinal grooves as described previously with respect to the embodiment of FIGS. 6–8.

Figure 14:
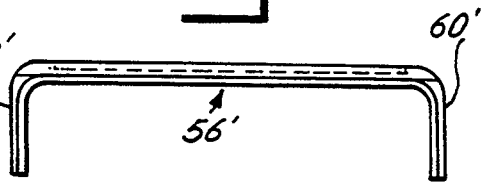
FIG. 14 is a front elevational view of the adapter plate of FIG. 13.
Figure 13A:
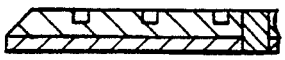
FIG. 13*a* is a fragmentary sectional view taken along the line A—A of FIG. 13.
Figure 15:
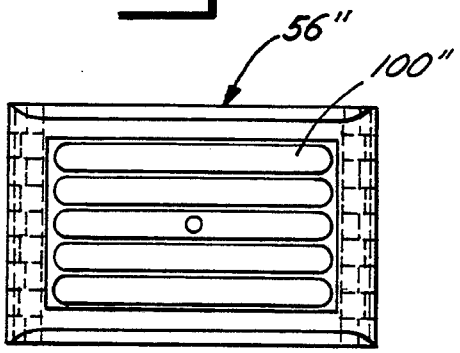
FIG. 15 is a top plan detail view of an alternative embodiment of an inverted U-shaped adapter plate where the metal backbone portion is removed from the two downwardly extending legs and is replaced with an elastomer which is softer than the outer layer.

FIGS. 15–18 illustrate a further alternative embodiment of the adapter plate. There is shown an adapter plate 56'' having a grooved top surface 100'' and a pair of depending end walls 58'' and 60''. The adapter plate 56'' is essentially the same as the adapter plate 56' of FIGS. 13 and 14 except the metal backbone of the two downwardly extending legs 58'' and 60'' has been removed and replaced with an elastomer softer than the outer layer.

Figure 12:
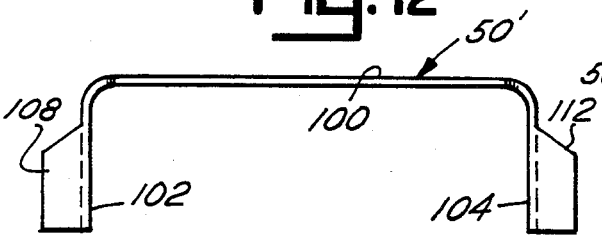
FIG. 12 is a front elevational view of the pedestal wear plate of FIG. 11.
Figure 16:
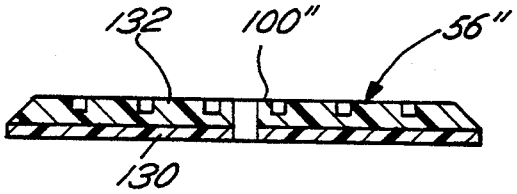
FIG. 16 is a sectional view taken along the line A—A of FIG. 15.
Figure 17:
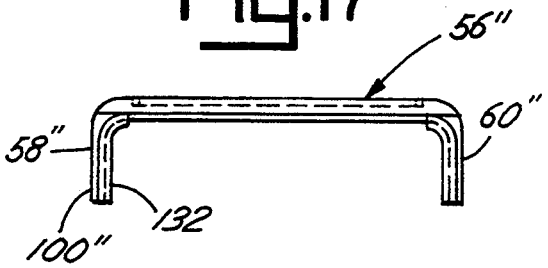
FIG. 17 is a front elevational view of the adapter plate of FIG. 15.
Figure 18:
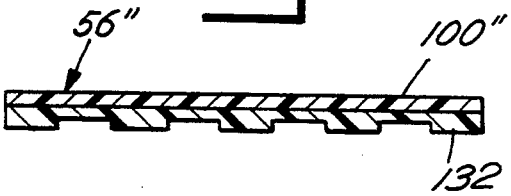
FIG. 18 is a sectional view taken along the line B—B of FIG. 17.

FIG. 16 shows the top surface 100'' in section and it comprises a metal plate portion or backbone 130 and a polymer pad 132 bonded to the top thereof. However, FIG. 18 illustrates a section through the depending end wall 58" and it shows the metal backbone replaced by an elastomeric layer 132 of about 90 A hardness. The elastomeric layer 132 is softer than the outer layer 100" which may be 315 Urethane and which extends down the outsides of the depending end walls 58" and 60" as described earlier in connection with the embodiment of FIGS. 12 and 13.

The primary advantage of the adapter plate 56" illustrated in FIGS. 15–18 is that it allows the truck assembly shown in FIG. 1 to negotiate curves easier. As a wheel goes into a curve, the softer polymer 132 will compress to permit the axle to align itself radially with the curve.

Figure 19:
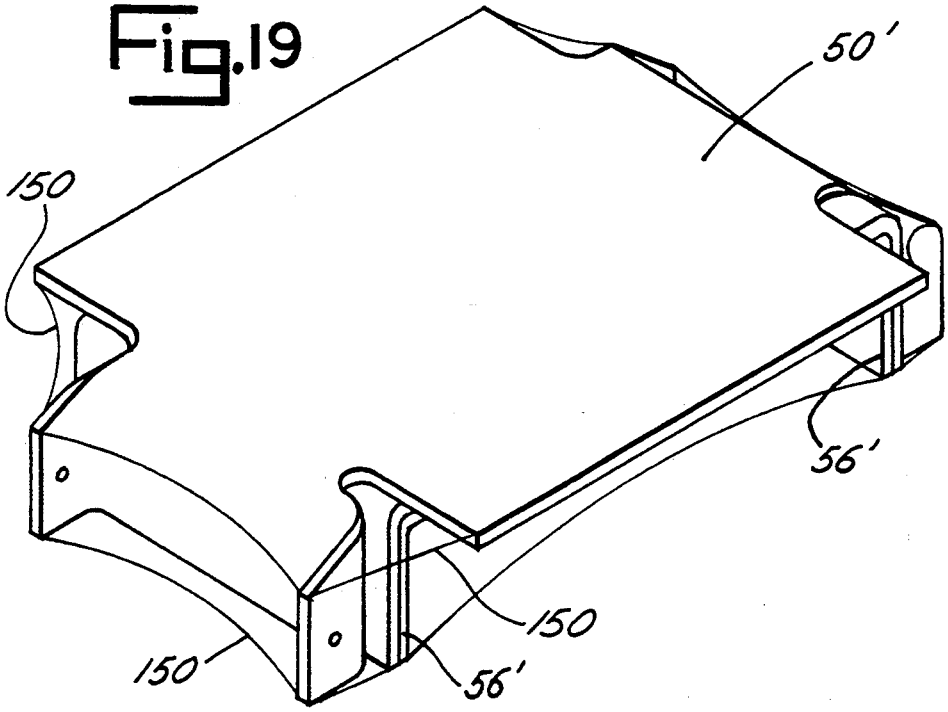
FIG. 19 is a perspective view showing an assembly of a pedestal liner and an adapter plate wrapped in a shrink wrap package.

An additional feature of the present invention involves a novel packaging concept shown in FIG. 19. This concept comprises producing a package including the pedestal liner 50' and the adapter plate 56'. Those two components are prelubricated at the plant, assembled together, and wrapped in a shrink wrap plastic bag 150 which is not removed prior to application. The plastic bag will remain sealed around the edges keeping dirt and other contaminates from fouling the contact surface between the adapter plate 56' and the pedestal liner 50'.

What is claimed is:

1. In a railway car truck assembly including a wheel set, a pair of axles, a pair of side frames, and a truck bolster, each side frame having a pedestal opening at each end thereof, a pair of opposing thrust lugs located on side walls which define each said pedestal opening in positions proximate a top of said pedestal opening, and a bearing assembly on each end of each axle positioned in a corresponding side frame pedestal opening for mounting the side frame on the end of a corresponding axle, the improvement comprising, in combination, a pedestal liner secured to said side frame to underlie a top wall of said pedestal opening, said pedestal liner having depending laterally extending end walls so said pedestal liner not only underlies said top wall of said pedestal opening but also wraps the inner faces of said thrust lugs, an adapter mounted in said pedestal opening on top of each said bearing assembly, said adapter having a thrust lug opening at each longitudinal end thereof, each said thrust lug opening being defined by a laterally extending adapter end wall and a pair of longitudinally extending laterally spaced shoulders, said shoulders being spaced greater than the lateral width of a corresponding thrust lug to permit predetermined lateral movement of said adapter relative to said side frame, an adapter plate mounted on top of said adapter, said adapter plate being of an approximately inverted U-shape having a top wall overlying a top of said adapter and a pair of longitudinally spaced depending end walls each of which extends down into a corresponding one of said thrust lug openings adjacent to and in covering relation with a corresponding adapter end wall, whereby when said adapter moves laterally relative to said side frame, said adapter plate depending end walls will slide against said pedestal liner depending end walls thereby protecting said thrust lugs and said adapter from wear.

2. The invention defined in claim 1 where a polymer pad is applied to the top of said adapter plate.

3. The invention defined in claim 2 where said polymer pad extends down the outside of said adapter plate depending end walls.

4. The invention defined in claim 3 where a plurality of longitudinally extending grooves are formed on the top of said polymer pad.

5. The invention defined in claim 2 where said polymer pad has a coefficient of friction in the range of 0.05 to 0.15.

6. The invention defined in claim 5 where said polymer pad comprises a thermoset polyurethane, polyester based material with a 70–75 shore D durometer.

7. The invention defined in claim 1 where a pair of laterally spaced longitudinal rails are formed on the top of said adapter, said adapter plate being dimensioned to fit between said rails which serve to retain said adapter plate against lateral movement relative to said adapter.

8. The invention defined in claim 1 where each of said depending end walls of said pedestal liner are formed with outwardly bent tabs at its two ends whereby said pedestal liner wraps three exposed sides of each thrust lug.

9. The invention defined in claim 1 where said longitudinally extending laterally spaced shoulders which define a thrust lug opening are spaced apart an amount sufficient to allow at least one-half inch lateral sliding movement of said adapter relative to said side frame.

10. The invention defined in claim 9 where said shoulders are spaced apart an amount sufficient to allow approximately ¾ths inch lateral sliding movement of said adapter relative to said side frame.

11. The invention defined in claim 1 where said adapter plate comprises a formed metal plate having a urethane pad bonded to the top thereof and also to the outside of said depending end walls of said adapter plate.

12. The invention of claim 11 where the metal portion of said depending end walls of said adapter plate is replaced with a urethane layer which is softer than said urethane pad.

13. In a railway car truck assembly including a wheel set, a pair of axles, a pair of side frames, and a truck bolster, each side frame having a pedestal opening at each end thereof, a pair of opposing thrust lugs located on side walls which define each said pedestal opening in positions proximate a top of said pedestal opening, and a bearing assembly on each end of each axle positioned in a corresponding side frame pedestal opening for mounting the side frame on the end of a corresponding axle, the improvement comprising, in combination, a pedestal liner secured to said side frame to underlie a top wall of said pedestal opening, said pedestal liner having depending laterally extending end walls so said pedestal liner not only underlies said top wall of said pedestal opening but also wraps the inner faces of said thrust lugs, an adapter mounted in said pedestal opening on top of each said bearing assembly, said adapter having a thrust lug opening at each longitudinal end thereof, each said thrust lug opening being defined by a laterally extending adapter end wall and a pair of longitudinally extending laterally spaced shoulders, said shoulders being spaced apart greater than the lateral width of a corresponding thrust lug by an amount sufficient to allow at least one-half inch lateral sliding movement of said adapter relative to said side frame, an adapter plate mounted on top of said adapter, said adapter plate being of an approximately inverted U-shape having a top wall overlying a top of said adapter and a pair of longitudinally spaced depending end walls each of which extends down into a corresponding one of said thrust lug openings adjacent to and in covering relation with a corresponding adapter end wall, whereby when said adapter moves laterally relative to said side frame, said adapter plate depending end walls will slide against said pedestal liner depending end walls thereby protecting said thrust lugs and said adapter from wear, and a polymer pad bonded to the top of said adapter plate to facilitate sliding movement between said adapter plate and the underside of said pedestal liner, said polymer pad extending down the outside of said adapter plate depending end walls to facilitate sliding between said adapter plate depending end walls and said pedestal liner depending end walls, and a pair of laterally spaced longitudinal rails formed on the top of said adapter, said adapter plate being dimensioned to fit closely between said rails which serve to retain said adapter plate against lateral movement relative to said adapter.

14. The invention defined in claim 13 where a plurality of longitudinally extending grooves are formed on the top of said polymer pad.

15. The invention defined in claim 13 where each of said pedestal liner depending end walls is formed with outwardly bent tabs at its two ends whereby said pedestal liner wraps three exposed sides of each said thrust lug.

16. The invention defined in claim 13 where said shoulders are spaced apart an amount sufficient to allow approximately ¾th inch lateral sliding movement of said adapter relative to said side frame.

17. The invention defined in claim 13 where said polymer pad has a coefficient of friction in the range of 0.05 to 0.15.

18. The invention defined in claim 13 where said polymer pad comprises a thermoset polyurethane, polyester based material with a 70–75 shore D durometer.

19. The invention defined in claim 13 where said adapter plate comprises a formed metal plate having a urethane pad bonded to the top thereof and also to the outside of said depending end walls of said adapter plate.

20. The invention defined in claim 19 where the metal portion of said depending end walls of said adapter plate is replaced with a urethane layer which is softer than said urethane pad.

* * * * *